US005581342A

United States Patent [19]

Yamauchi

[11] Patent Number: 5,581,342

[45] Date of Patent: Dec. 3, 1996

[54] IMAGE FORMING APPARATUS WITH A REMOVABLE WASTE TONER COLLECTING CONTAINER

[75] Inventor: Hirokazu Yamauchi, Uji, Japan

[73] Assignee: Sharp Kabushiki Kaisha, Osaka, Japan

[21] Appl. No.: 511,624

[22] Filed: Aug. 7, 1995

[30] Foreign Application Priority Data

Aug. 10, 1994 [JP] Japan ..... 6-188478

[51] Int. Cl.[6] ..... G03G 21/00

[52] U.S. Cl. ..... 355/298; 355/208

[58] Field of Search ..... 355/200, 203, 355/208, 210, 215, 260, 296, 298

[56] References Cited

U.S. PATENT DOCUMENTS

| | | | |
|---|---|---|---|
| 4,982,230 | 1/1991 | Ogura et al. | 355/298 X |
| 4,982,231 | 1/1991 | Matsuuchi | 355/298 X |
| 5,130,756 | 7/1992 | Taniyama | 355/298 |
| 5,132,740 | 7/1992 | Okamoto et al. | 355/298 |
| 5,237,373 | 8/1993 | Aimoto et al. | 355/298 |
| 5,260,755 | 11/1993 | Imaizumi | 355/298 |
| 5,285,250 | 2/1994 | Yoshioka | 355/298 |

FOREIGN PATENT DOCUMENTS

| | | |
|---|---|---|
| 377973 | 8/1991 | Japan . |
| 4134391 | 5/1992 | Japan . |
| 517665 | 3/1993 | Japan . |

*Primary Examiner*—Sandra L. Brase

[57] ABSTRACT

Waste toner is collected in a collecting container. When a full-state condition of the collecting container is detected; if a door is opened, a stepping motor is activated to move the collecting container from a mounted position to a demounting position. In an operational situation where a paper-guide plate is opened when a paper jam is detected in a vertical conveyer; even if the collecting container is full, the collecting container remains at a stand still at the mounted position. When the full collecting container is replaced with an empty collecting container at the demounting position, the stepping motor is activated to rotate in the reverse direction so that the collecting container is returned from the demounting position to the mounted position. The collecting container when filled can optionally be moved by a mechanical weight system. Optionally the container can be moved to a mounted position manually.

6 Claims, 12 Drawing Sheets

IMAGE FORMING APPARATUS WITH A REMOVABLE WASTE TONER COLLECTING CONTAINER

BACKGROUND OF THE INVENTION (1) Field of the Invention

The present invention relates to an image forming apparatus for example, copiers, printers etc., and more particularly the invention is directed to a device for mounting and demounting a waste-toner collecting container for holding waste toner.

(2) Description of the Prior Art

A typical copier using toner, has a waste-toner collecting container for holding residual toner which, without being transferred to a copy paper, is collected in the image forming process. When the amount of held toner in the waste-toner collecting container of this kind is designed to be small in order to make the whole apparatus small and light-weight, the container will fill soon and require frequent maintenance such as replacement of the container etc. To avoid this, the container should be designed to have a certain holding amount or more.

As a conventional example, Japanese Patent Application Laid-Open Hei 4 No.134,391 discloses a copier which has a waste-toner collecting container with an adequate collecting amount and does neither interfere with other device units nor deteriorate maintenance performance of them. This copier, as shown in FIG. 1, has a collecting container 4 mounted in a space under an electrophotographic processing unit 1 and in the rear of a paper feeding device 2 for conveying fed copy paper (in the lower portion on the backside of a copier body 3). The workability of replacement of the collecting container 4, however, has been a problem in this configuration.

When the copier having such a configuration is constructed so that the collecting container 4 full of waste-toner is demounted from the flank or the backside of the copier body 3, the copier body 3 should be placed in a room spaced from walls of the room or any other obstruction. Therefore, the site of the copier to be placed will be limited. To make matters worse, pre-processing and/or post-processing devices such as a large-capacity paper feeder and a stapling sorter may be equipped on the flank of the copier body 3. In such a case, the pre-processing unit or the post-processing unit must be detached before the collecting container 4 is taken out from the flank of the copier body 3. This markedly complicates the workability of the copier. On the other hand, if the copier is configured so that the collecting container 4 is demounted from the top of the copier body 3, the electrophotographic processing unit 1 etc., disposed over the collecting container 4 should be removed. This configuration also causes troublesome handling.

In order to achieve the best workability, the copier should be constructed so that the collecting container 4 may be demounted from the front side of the copier body. However, since the collecting container 4 is disposed on the backside of the copier body 3; in order to pick out the collecting container 4, the operator must stretch out his hand deep into the inside of the copier through a gap between the paper feeding device 2 and the copier body 3, from the front side. This operation is not only difficult, but also the operator could be injured by edges of metal parts inside the copier body 3 when the operator stretches his hand into the inside of the machine. As described above, in the conventional configurations, a space should be secured for demounting the container; otherwise a highly troublesome, complicated operation is required.

SUMMARY OF THE INVENTION

In view of what has been discussed above, it is an object of the present invention to provide an image forming apparatus wherein a waste-toner collecting container placed in the rear part of the image forming apparatus body can be easily taken out and replaced from the front side of the image forming apparatus body.

In accordance with a feature of the present invention, an image forming apparatus comprises: an image forming apparatus body; an image forming portion disposed in the image forming apparatus body; a paper conveying portion for feeding a copy paper and delivering the paper to the image forming portion; a waste-toner collecting container provided removably for collecting waste toner arising from the image forming process in the image forming portion, the collecting container being mounted in the rear side of the paper conveying portion in the image forming apparatus body; and a door disposed on the front side of the image forming apparatus body and capable of being opened and closed, and is constructed such that there is a moving means which moves the collecting container set in a mounted position in the rear part of the image forming apparatus body, to a demounting position on the front side from where the collecting container can be taken out through the opening of the door, when the door is opened and the collecting container is full of waste toner.

In the above configuration, any of the following features is effective:

That is, the image forming apparatus further comprises a full-state condition detecting means for detecting whether the collecting container is full, and constructed such that the moving means moves the collecting container from the demounting position to the mounted position when the collecting container is unfilled.

Alternatively, the image forming apparatus, further comprises a door-linking mechanism which, linking with the opening and closing of the door, causes the moving means to move in the same direction with the moving direction of the collecting container, and constructed such that the position of the collecting container is displaced depending on the weight of collected waste toner so that the door-linking mechanism is engaged with the collecting container when the collecting container is full of waste toner.

Moreover, the image forming apparatus further comprises: a paper-guide plate disposed in the paper conveying portion and capable of being opened and closed for removing paper jammed in the paper conveying portion; and a movement checking means for preventing the collecting container from moving when a paper-guide plate is opened so that the same space is commonly used for the movement of the collecting container and for the opening and closing actions of the paper-guide plate.

In the means to be solved by the present invention, when waste toner is accumulated in the collecting container and the container becomes filled; as the door is opened in order to replace the collecting container, the collecting container is moved from the mounted position to the demounting position. But, if the door is opened when the collecting container is not full, the collecting container remains at a stand still at the mounted position.

In accordance with the present invention, when the collecting container, which has been moved to the demounting position, is replaced with an unfilled (empty) collecting container, the collecting container is made to return from the demounting position to the mounted position. If no replacement of the collecting container is done and the collecting container full of waste toner occupies the demounting position, the collecting container remains standing at the demounting position to warn the operator of the need of replacement.

In accordance with the invention, as waste toner builds up, the collecting container is displaced. When the collecting container becomes full, the collecting container is made to link with the door linking mechanism. In this condition, when the door is opened, the door linking mechanism moves from the back side of the image forming apparatus body toward the front side, whereby the collecting container is moved from the mounted position to the demounting position.

Further, in accordance with the present invention, in the case where a paper jam occurs in the paper conveying portion; when the door and the paper-guide plate are opened in order to cancel the paper-jam state, the collecting container stands still at the mounted position even though the collecting container is full. Accordingly, if the same space is commonly used for the movement of the collecting container and for the opening and closing of the paper-guide plate, there is no possibility of interference between the collecting container and the paper-guide plate. When the paper-guide plate is closed after the cancellation of the paper jam; if the collecting container is full, the collecting container is moved from the mounted position to the demounting position.

DESCRIPTION OF THE PREFERRED EMBODIMENTS

Embodiments of the present invention will be described specifically with reference to the accompanying drawings.

(First embodiment)

Figure 1:
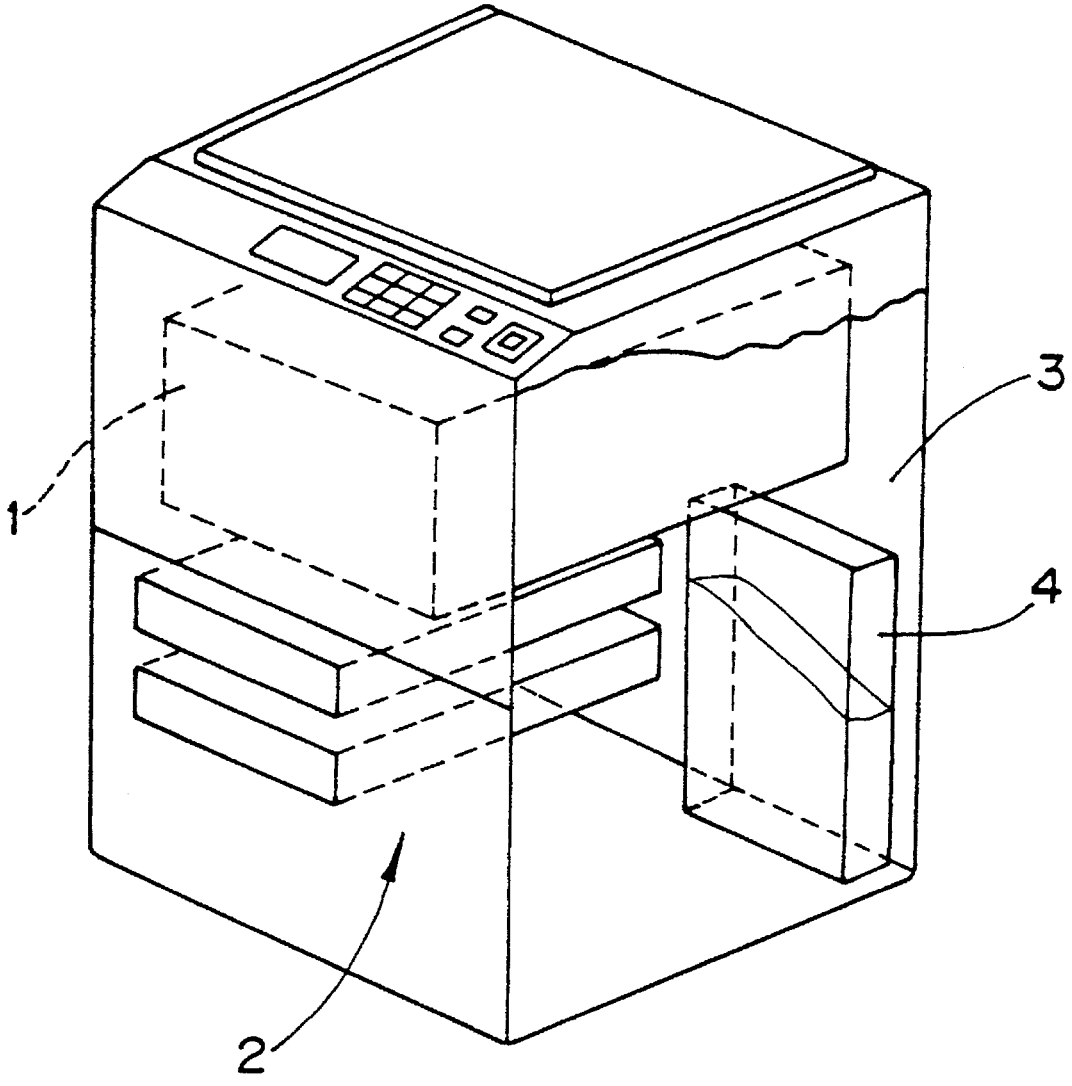
FIG. 1 PRIOR ART
FIG. 1 is a perspective view showing a mounted position of a collecting container for a prior art copier.
Figure 2:
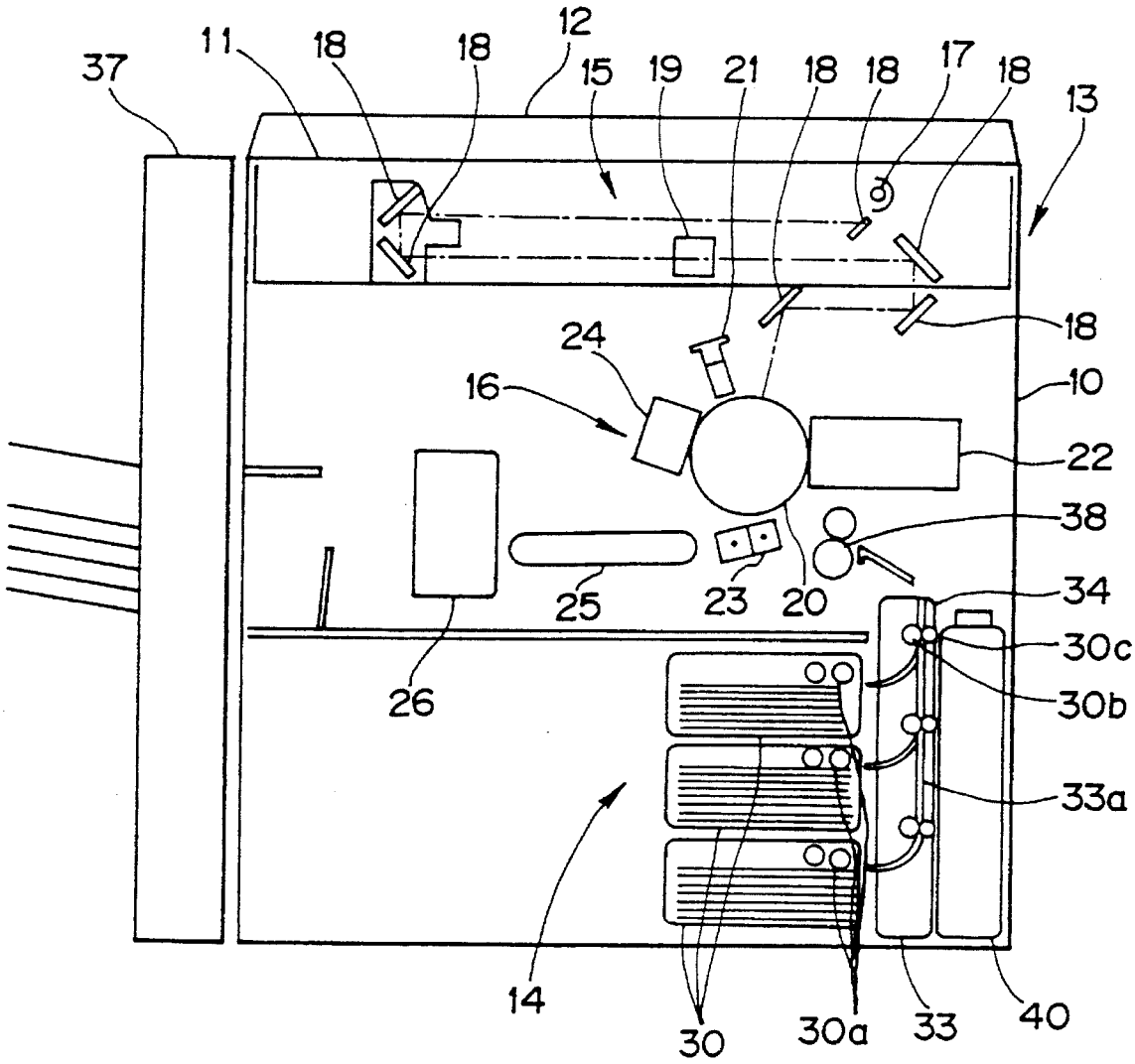
FIG. 2 is an overall constructional view showing a copier of a first embodiment of the present invention.

A copier in accordance with a first embodiment of the invention, as shown in FIG. 2, has a transparent original setting table 11 on top of a copier body 10. An original cover 12 capable of being freely opened and closed is provided on the top of the copier body 10 for covering the original setting table 11. The copier body 10 contains an image forming portion 13 for effecting the image forming process and a paper conveying portion 14 for feeding a copy paper from the lower part of the image forming portion 13 and delivering it to the image forming portion 13.

The image forming portion 13 includes an optical system 15 and an electrophotographic processing unit 16. The optical system 15 comprises a copy lamp 17 of halogen lamps and the like, a plurality of reflecting mirrors 18 and a lens unit 19. These reflecting mirrors 18 are arranged so that light emitted from the copy lamp 17 and reflected on an original set on the original setting table 11 may be guided as indicated by a chained line onto a photoreceptor 20 to expose it. The lens unit 19 serves to refract and condense the reflected light brought by the mirrors 18 so that the reflected light forms a clear image on the photoreceptor 20. The electrophotographic processing unit 16 includes the photoreceptor 20. Provided around the photoreceptor 20 are a main charger 21 for charging the photoreceptor 20 so that a static latent image may be created on the photoreceptor 20; a developing unit 22 supplying toner for the static latent image formed on the photoreceptor 20 to create a visualized image; a transfer charger 23 for transferring the toner image on the photoreceptor 20 to a copy paper; and a cleaning unit 24 for scraping the waste toner which has not been transferred and still remains on the photoreceptor 20 after the transferring operation. The paper with a toner image transferred thereto is delivered out from the photoreceptor 20. Provided on the downstream side of the photoreceptor 20 is a belt type conveying device 25 for carrying the paper thereon and conveying it. The toner image on the paper conveyed by the conveying device 25 is heated and fused in a fixing unit 26 provided downstream of the conveying device 25.

Figure 3:
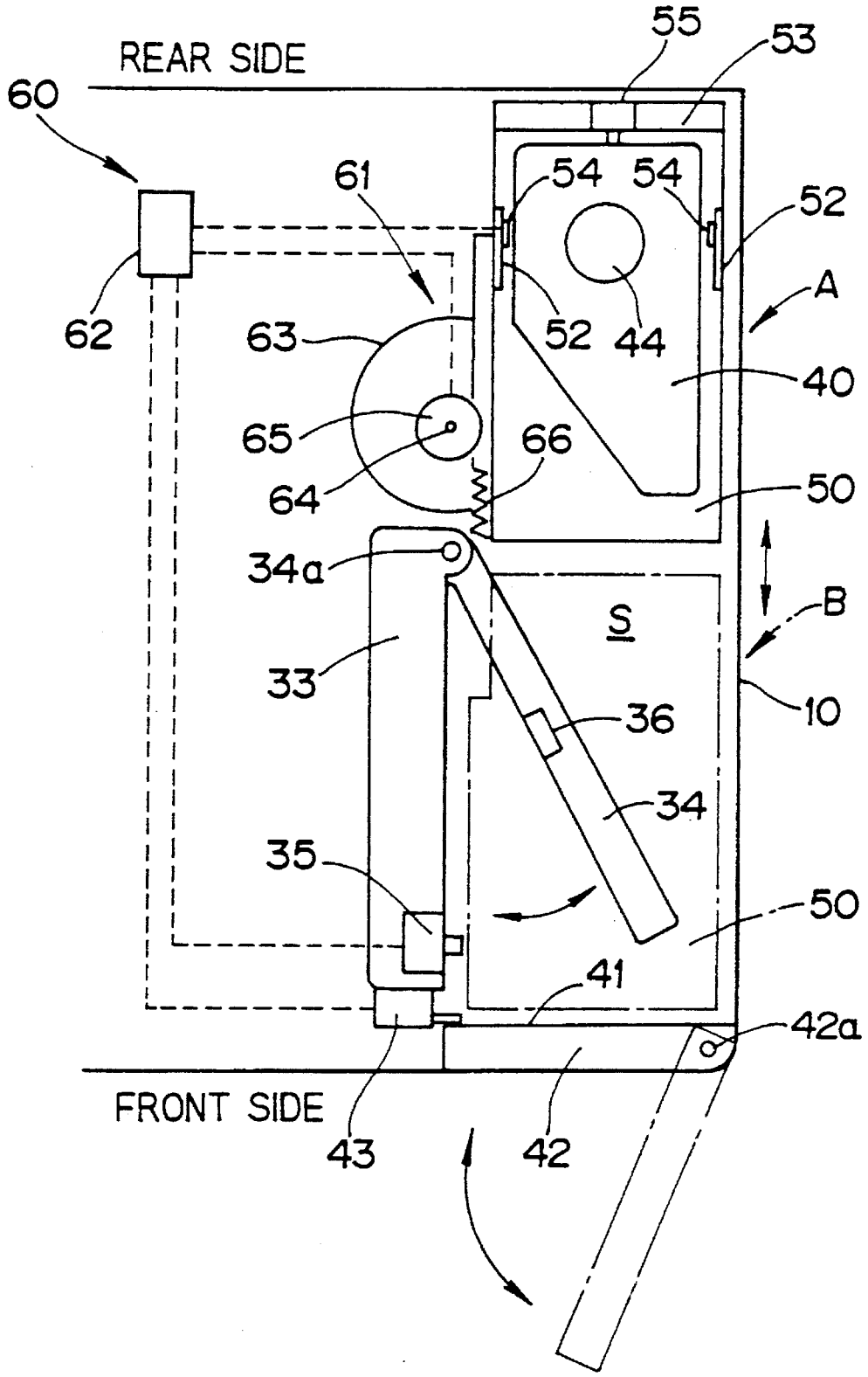
FIG. 3 is a partial constructional view of the copier in the first embodiment of the present invention.

The paper conveying portion 14 comprises: vertically arranged three paper cassettes 30 each of which can be drawn in and out from the front side of the copier body 10; and a vertical conveyer 33 which conveys copy sheets delivered from any of the paper cassettes 30 by means of a feed roller 20*a*, upward or toward the transfer position. The vertical conveyer 33 is composed of a paper conveying path 33*a* for conveying sheet vertically from any of the paper cassettes 30; three conveying rollers 30*b* arranged along the paper conveying path 33*a*; and three driven rollers 30*c* paired and driven with corresponding conveying rollers 30*b*; and a paper-guide plate 34 which rotatably supports the driven rollers 30*c* and forms a part of the paper conveying path 33*a*. The paper-guide plate 34, as shown in FIG. 3, is attached to the vertical conveyer 33 by means of a hinge 34*a* so that the plate 34 may be opened and closed in the lateral direction of the copier body 10. This structure allows the user to take out a jammed paper or to deal with any other trouble. A guide-plate opening/closing detecting sensor 35 of a micro switch is attached on the vertical conveyer 33 in order to detect the position, or opened or closed situation of the paper guide plate 34. Attached on the paper guide plate 34 is an actuator type paper-jam detecting sensor 36 for detecting a paper-jam state in the vertical conveyer 33.

Designated at 37 in FIG. 2 is a stapling sorter to which sheets with toner images fixed are discharged. A reference numeral 38 designates a registration roller for delivering a sheet conveyed by the vertical conveyer 33, to the transfer station, in synchronism with a timing of the image forming operation.

A waste toner collecting container 40 for collecting waste toner sent from the cleaning unit 24 is mounted in a space under the image forming portion 13 in the rear of the vertical conveyer 33, or at the lower corner on the backside of the copier body 10. As shown in FIGS. 2 and 3 the collecting container 40 is mounted in a space designated at A in FIG. 3, or in such a position as not to interfere with the opening and closing of the paper-guide plate 34 of the vertical conveyer 33. This space (designated at S) for the opening and closing of the paper-guide plate 34 also serves as a space in which the collecting container 40 is moved toward the front side of the copier body 10. The space S is enclosed by the flank of the copier body 10, the forward side of the collecting container 40 and the paper-guide plate 34.

Formed on the front side of the space S, in other words, in the front lower position of the copier body 10, is an opening 41 through which a paper jam in the vertical conveyer 33 is canceled and the collecting container 40 is taken out and replaced. A door 42 hinged by a rod 42*a* is provided on the front side of the copier body 10 in order to open and confine the opening 41. A micro switch which serves as a door opening/closing detecting sensor 43 for detecting the opening and closing of the door 42 is attached on the front side of the copier body 10 in the vicinity of the opening 41.

Figure 4:
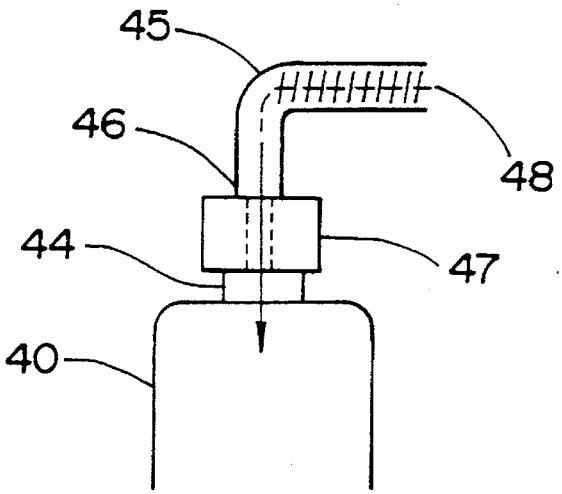
FIG. 4 is a jointing portion between a collecting container and a conveying pipe.

The collecting container 40 is formed of a synthetic resin or the like and is a trapezoidal-shaped (viewed from the top) box with an opening 44 on top. A conveying tube 45 which is connected to the cleaning unit 24 etc., and transports waste toner to the collecting container 40, is disposed above the opening 44 as shown in FIG. 4. A coupling jacket 47 formed of a flexible material is attached to a discharging port 46 of the conveying tube 45. The opening 44 of the collecting container 40 is brought into pressing contact with the coupling jacket at the mounted position A. As the collecting container 40 and therefore the opening 44 is moved, the coupling jacket 47 resiliently deforms so that the opening 44 is made apart from the coupling jacket 47. In FIG. 4, a reference numeral 48 designates a rotatable screw disposed inside the conveying tube 45 for transporting waste toner. This screw 48 is rotated by an illustrated motor.

Figure 5:
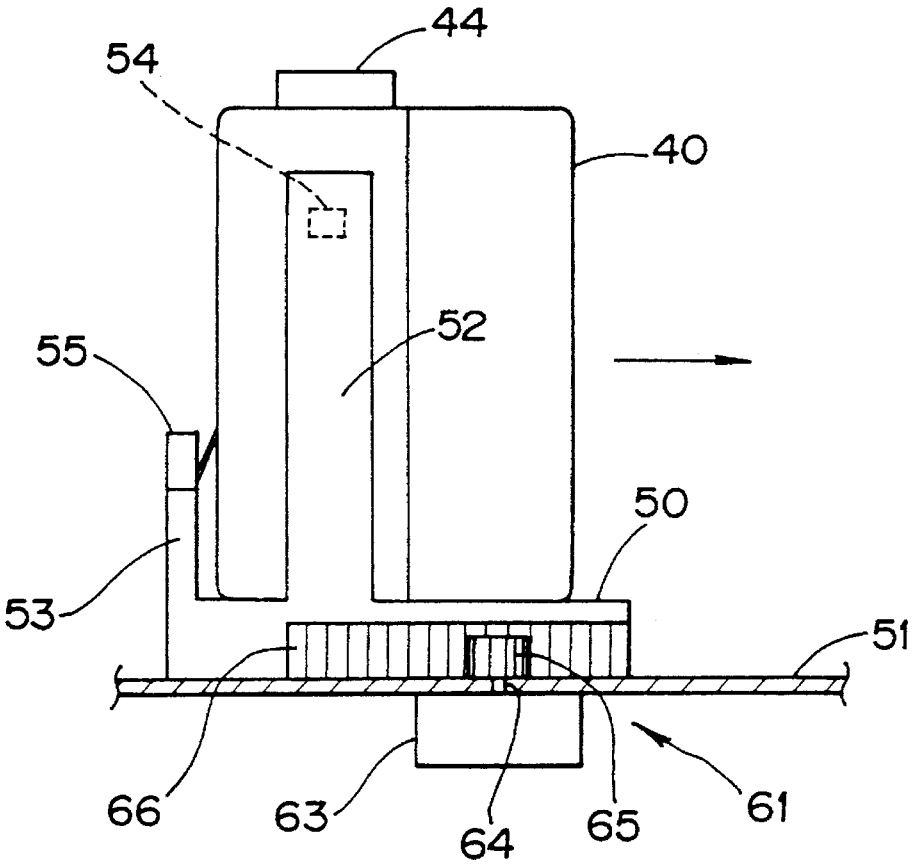
FIG. 5 is a side view showing a container holding plate with a collecting container mounted.

As shown in FIGS. 3 and 5, the collecting container 40 is detachably mounted on a rectangular-shaped (viewed from the top) container holding plate 50. This container holding plate 50 is slidably mounted on a flat table 51 which lies from the rear face side to the front face side at the bottom of the copier body 10. Rollers or the like may be attached rotatably on the undersurface of the container holding plate 50 so that the rollers can roll along guide grooves, guide rails or the like formed on the flat table 51 or on the bottom of the copier body 10. In order to fix the collecting container 40 at a predetermined position on the container holding plate 50, a positioning projection may and should be formed on the container holding plate 50.

Figure 6:
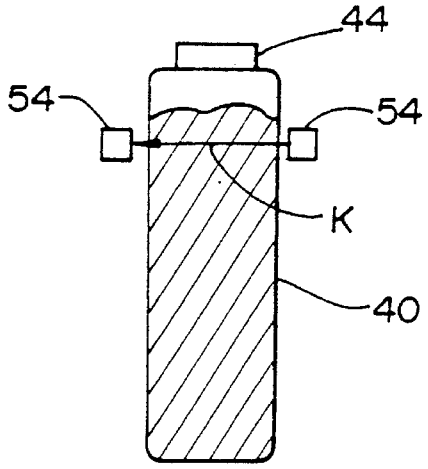
FIG. 6 a view showing an arrangement of a sensor for detecting a full-state condition of a collecting container.

Sensor mounting plates 52 and 53 are formed upright along the wall of the collecting container 40 on both sides and on the rear side of the container holding plate 50. A pair of photosensors as a full-state detecting sensor 54 for detecting whether waste toner in the collecting container 40 reaches its full-level are mounted on right and left sensor mounting plates 52 while a micro switch for a container-placement detecting sensor 55 is mounted on backside mounting plate 53 in order to detect whether the collecting container 40 is mounted on the container holding plate 50. The photo sensors for the full-state detecting sensor 54 are disposed as shown in FIG. 6 in such a position that a light path K between the sensor elements will be blocked when the collecting container 40 is filled with waste toner. That is, when the light path K is blocked, the sensor 54 detects the full-state of the collecting container 40. In this configuration, small holes or transparent windows may be provided for the collecting container 40 in corresponding positions to the light path K, whereby it is possible to detect the full state with higher precision.

A moving means 60 is provided as shown in FIG. 3, which, in accordance with a designated condition, causes the collecting container 40 on the container holding plate 50 to move between the mounted position A on the rear side in the copier 10 and the demounting position B on the front side where the container 40 can be taken out through the door 42. This moving means 60 comprises a driver 61 for imparting moving force to the container holding plate 50; and a controller 62 for controlling the operation of the driver 61 in accordance with output signals from different sensors 35, 36, 43, 54 and 55.

The aforementioned driver 61 is composed as shown in FIG. 5 of a forward/reverse rotatable stepping motor 63, a pinion 65 fixed on a motor shaft 64 of the stepping motor 63, and a rack 66 which is formed along one side of the container holding plate 50 and engaged with the pinion 65.

The controller 62 is of a microcomputer having a CPU and the like and has the following functions: when the paper-jam detecting sensor 36 detects a paper-jam state in the vertical conveyer 33 or when the full-state detecting sensor 54 detects the full-state of waste toner in the collecting container 40, the controller 62 effects a display function or instructs an unillustrated display panel provided for the copier body 10 to indicate the paper jam condition or the full-state condition of the collecting container 40; when the full-state detecting sensor 54 detects the full-state of waste toner in the collecting container and if the door 42 is opened and therefore the door opening/closing detecting sensor 43 is turned off, the controller 62 effects a demounting function or activates the stepping motor 63 to move the collecting container 40 on the container holding plate 50 from the mounted position A to the demounting position B; and when the paper-guide plate 34 is opened and the guide-plate opening/closing detecting sensor 35 is turned off, the controller 62 effects a movement stopping function or deactivates the stepping motor 63 to stop the movement of the collecting container 40 on the container holding plate 50. Further, as in a case where the collecting container 40 filled with waste toner therein is taken out and an empty collecting container 40 is set in place; when the collecting container 40 is set on the container holding plate 50 so that the container-placement detecting sensor 55 becomes turned on while the full-state detecting sensor 54 detects the unfilled state (empty state) of the collecting container 40, the controller 62 effects a mounting function or causes the stepping motor 63 to rotate in the reverse direction to move the collecting container 40 on the container holding plate 50 from the demounting position B to the mounted position A.

In the above configuration, when the image forming process is effected in the image forming portion 13, toner which has not been transferred to the copy sheet and becomes useless is transported as waste toner by way of the conveying tube 45 from the cleaning unit 24 or the like. The waste toner then is discharged from the discharging port 46 of the conveying tube 45, falling into collecting container 40 through the coupling jacket 47 and being accumulated therein. In this operation, since the opening 44 of the collecting container 40 is made in pressing contact with the coupling jacket 47, the waste toner will never scatter and pollute the inside of the copier body 10.

As waste toner builds up in the collecting container and the waste toner blocks the light path of the full-state detecting sensor 54, the full-state detecting sensor 54 detects the full-state condition of the collecting container 40 while the display panel displays that the collecting container 40 is full. Here, when the door 42 is opened in order to replace the collecting container 40, the door opening/closing detecting sensor 43 is turned off and the stepping motor 63 is activated. The driving force is transferred to the pinion 65 and the rack 66, so that the container holding plate 50 with the collecting container 40 thereon slides on the flat table 51 from the mounted position A to the demounting position B. During this movement, the opening 44 of the collecting container 40, as resiliently deforming the coupling jacket 47, separates from the coupling jacket 47.

On the other hand, even if the door 42 is opened and therefore the door opening/closing detecting sensor 43 is turned off; when the collecting container 40 is not full or the waste toner does not block the light path of the full-state detecting sensor 54, the full-state detecting sensor 54 will detect no full-state of the collecting container 40. Accordingly, the stepping motor 63 will not be activated so that the collecting container 40 stands still at the mounted position A.

When paper jam occurs in the vertical conveyer 33 and the paper-jam detecting sensor 36 detects the paper-jam state, the display panel displays the occurrence of paper jam. At this moment, the operator opens the door 42 and releases the paper-guide plate 34 in order to cancel the paper-jam state, the door opening/closing detecting sensor 43 as well as the guide-plate opening/closing detecting sensor 35 is turned off. In this situation, even when the full-state detecting sensor 54 detects that the collecting container 40 is full, the stepping motor 63 will not be driven therefore the collecting container 40 stands still at the mounted position A. Here, in the case where the collecting container 40 is full; if the stepping motor 63 is driven immediately after the door 42 is opened, the collecting container 40 comes in the way so as not to allow the paper-guide plate 34 to be opened. Therefore, the activation of the stepping motor 63 is delayed behind the deactivation of the door opening/closing detecting sensor 43, thereby making it possible for the operator to open the paper-guide plate 34 in this time lag.

As a result, there is no possibility of interference between the collecting container 40 and the paper-guide plate 34 when the same space is commonly used for the movement of the collecting container 40 and for the opening and closing actions of the paper-guide plate 34. When paper jam is canceled and the paper-guide plate 34 is closed, the guide plate opening/closing detecting sensor 35 turns on. In this situation, if the full-state detecting sensor 54 detects that the collecting container has been filled with waste toner, the collecting container 40 is slid from the mounted position A to the demounting position B.

When the operator takes out from the container holding plate 50 the collecting container 40 which is full of waste toner therein and has been slid to the demounting position B and places an embody collecting container 40 on the container holding plate 50, the container-placement detecting sensor 55 turns on while the full-state detecting sensor 54 detects that the collecting container 40 is not full (empty state). Then, the stepping motor 63 rotates in the reverse direction, to thereby drive the collecting container 40 on the container holding plate 50 from the demounting position B toward the mounted position A. During this movement, the opening 44 of the collecting container 40, as deforming the coupling jacket 47, comes into pressing contact with the coupling jacket 47, whereby the collecting container 40 is mounted into the mounted position A. If the collecting container 40 with waste toner filled therein has not been replaced and remains placed on the container holding plate 50, alternatively, if the collecting container 40 has not been placed on the container holding plate 50, the stepping motor 63 will not be activated and the collecting container 40 stands still at the demounting position B while the apparatus urges the operator to mount or replace the collecting container 40.

As has been described, in the first embodiment, when the collecting container 40 in the mounted position A on the rear part of the copier body 10 is full of waste toner, only the opening operation of the door 42 automatically causes the collecting container 40 to move from the mounted position A to the demounting position B or the front side of the copier body 10 where the container can be easily handled. Therefore, the collecting container 40 can be replaced more easily and efficiently than in the conventional configurations in which the operator should stretch out his hand deep into the inside of the copier body to pick out the collecting container or in which the copier body should be placed in a room spaced from the wall of the room and any other obstruction in order to allow the operator to take out the collecting container from the flank or the backside of the copier body.

When the operator only demounts the collecting container 40 which has been full of waste toner and slid to the demounting position B and places an unfilled collecting container 40 onto the container holding plate 50, it is possible to automatically cause the unfilled collecting container 40 to move back from the demounting position B to the mounted position A. Therefore, the replacing work can be done more easily and efficiently. If the collecting container 40 full of waste toner remains mounted on the container holding plate 50, the collecting container 40 will stand still at the demounting position B, so that it is possible to prevent the operator from finishing the operation without replacing the collecting container 40.

Since the same space is commonly used for the movement of the collecting container 40 and for the opening and closing actions of the paper-guide plate 34 for canceling paper jam in the vertical conveyer 33, it is possible to effectively use the space S in the copier body, thus making the apparatus compact. Further, as long as the paper-guide plate 34 is opened, the collecting container 40 stands still at the mounted position A even though the collecting container 40 is full. Therefore, it is possible to prevent the interference between the collecting container 40 and the paper-guide plate 34. When the paper-guide plate 34 is closed after the cancellation of paper jam in the vertical conveyer 33, the collecting container 40, if it is full, moves to the demounting position B. Accordingly, it is possible to prevent the operator from forgetting to replace the collecting container 40 after the cancellation of the paper jam.

(Second embodiment)

Figure 7:
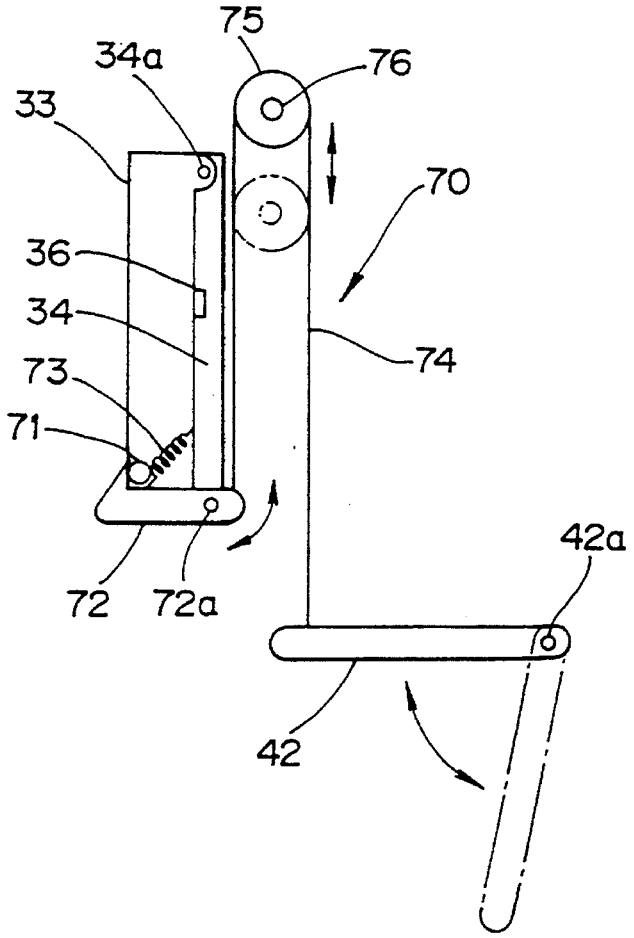
FIG. 7 is a constructional view showing a linking mechanism in a second embodiment of the present invention.

In a second embodiment, a linking mechanism 70 which, as shown in FIG. 7, opens and closes the paper-guide plate 34 in conformity with the opening and closing of the door 42, is provided for the copier of the first embodiment.

Figure 8:
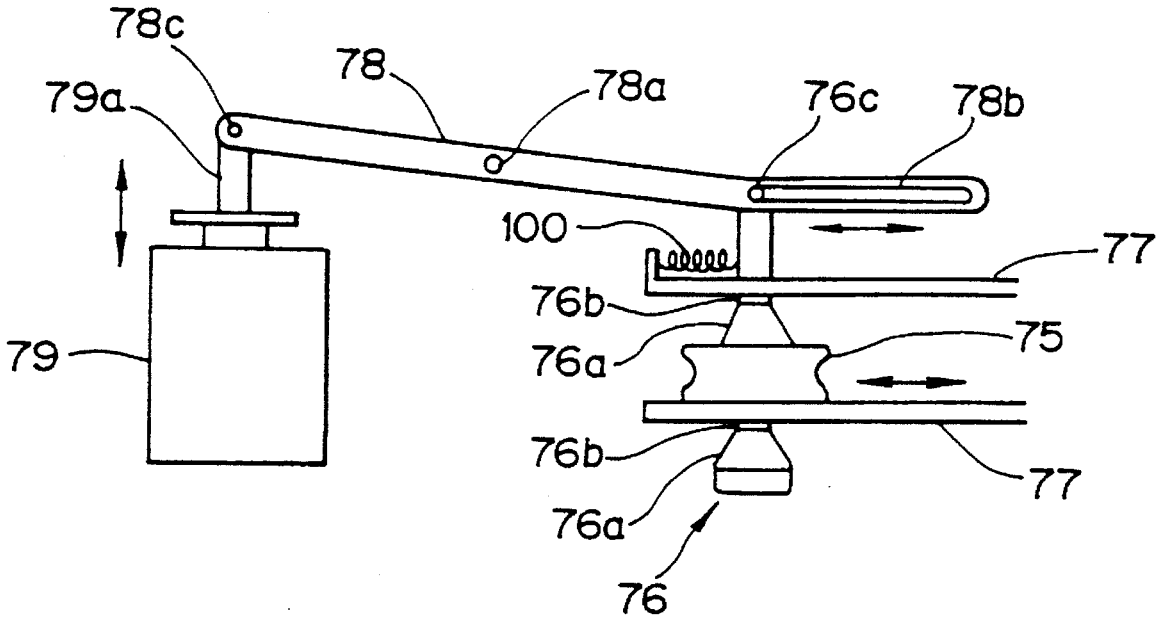
FIG. 8 is a side view showing a pulley portion in the linking mechanism.
Figure 9:
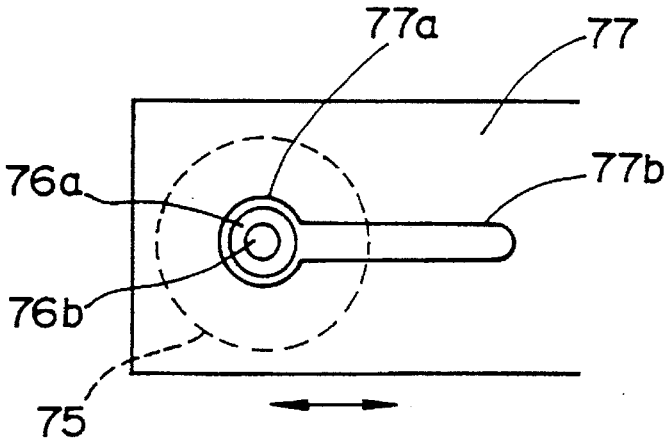
FIG. 9 is a plan view showing a slide frame.

This linking mechanism 70, as shown in FIGS. 7, 8 and 9, comprises: an engaging projection 71 formed on the front side on top of the body of the vertical conveyer 33; a locking claw 72 which is horizontally rotatably attached to the front part on top of the door 42 by means of an axis 72*a* and meshes with the engaging projection 71; a spring 73 disposed between the paper guide plate 34 and he locking claw 72 to urge the locking claw 72 toward the engaging direction; a wire 74 which is attached at its one end to one end of the locking claw 72 and connected at the other end to the opposite end of the door 42 to the rod 42*a*; a pulley 75 around which the wire 74 is wound; a pair of upper and lower slide frames 77 for supporting a pulley shaft 76 of the pulley 75 so that the pulley 75 may horizontally move forward and rearward; and a solenoid 79 for driving the pulley 75 up and down by means of a linking arm 78. An unillustrated spring urging the paper-guide plate 34 toward its closing direction is interposed between the paper-guide plate 34 and the body of the vertical conveyer 33.

The pulley shaft 76 of the pulley 75 is composed of two vertically arranged parts, as shown in FIG. 8, each of which is formed of a conical thick part 76*a* and a cylindrical thin part 76*b* by tapering. Each slide frame 77 has a large diameter circular hole 77*a* into which the thick part 76*a* of the pulley shaft 76 is fit when the pulley 75 is moved up, and an elongated slot 77*b* which continuously extends to the forward side from the circular hole 77*a* and guides the thin part 76*b* of the pulley shaft 76 in the forward and rearward directions when the pulley 75 is not moved up. A spring 100 pressing the pulley shaft 76 rearward is interposed between the upper slide frame 77 and the upper thin part 76*b* of the pulley shaft 76.

The linking arm 78 is supported by a fixed axis 78*a* so as to oscillate up and down. Provided for the front end of the linking arm 78 is an elongate guide slot 78*b* which receives an engaging projection 76*c* disposed at an upper end of the pulley shaft 76 and allows the projection 76*c* to slide forward and rearward. The rear end of the arm 78 is attached rotatably to a moving core 79*a* of the solenoid 79 by means of an axis 78*c*. Here, all the parts of the linking mechanism 70 are arranged above the space for movement of the collecting container 40 so as not to interfere with one another while the collecting container 40 is being moved.

In the case where the linking mechanism 70 is provided, the paper-guide plate 34 might always be opened in response to the opening of the door 42, regardless of whether paper has jammed. To avoid this, the controller 62 must have a door-opening limiting function: that is, if the door 42 is opened and the door opening/closing detecting sensor 43 turns off while the paper-jam detecting sensor 36 has been detected paper-jam occurring in the vertical conveyer 33, the solenoid 79 will be turned on. Further, the controller 62 must have a movement prohibiting function: that is, when the paper-jam detecting sensor 36 detects a paper-jam state and the paper-guide plate 34 is opened, the guide-plate opening/closing detecting sensor 35 is turned off. In this condition, the stepping motor 63 must stop driving so that the collecting container 40 on the container holding plate 50 is prohibited from moving.

Now, description will be made on operations of related components in association with turn-on and turn-off states of the solenoid 79. When the solenoid 79 turns on and the moving core 79*a* goes down, the pulley 75 is moved up by the linking arm 78 so that thick parts 76*a* of the pulley shaft 76 fit into corresponding circular holes 77*a* of the slide frames 77, whereby the pulley 75 is prohibited from moving. In this condition, if the door 42 is opened, the end part of the locking claw 72 for the paper-guide plate 34 is pulled by the wire 74, so that the locking claw 72, opposing to the urging force of the spring 73, rotates on the axis 72*a*. This rotation releases the engagement between the locking claw 72 and the engaging projection 71 of the vertical conveyer 33, so that the paper-guide plate 34 is pulled by the wire 74 and opened. When the door 42 is closed, the wire 74 is made loose. Then, the urging force by the spring interposed between the paper-guide plate 34 and the body of the vertical conveyer 33 automatically closes the opened paper-guide plate 34. During the closing action, the hooking part of the locking claw 72, abutting the engaging portion 71 as the paper-guide plate 34 rotates, is pressed slightly forward and then pulled backward by the urging force of the spring 73 to thereby mate with the engaging projection 71.

On the other hand, when the solenoid 79 is off, the pulley 75 will not move up, therefore the pulley is able to move forward and rearward. In this condition, if the door 42 is opened, the pulley 75 is pulled forward by the wire 74 and slides forward while the engaging projection 76*c* of the pulley shaft 76 and thin parts 76*b* being guided by the guide slot 78*b* of the linking arm 78 and elongated slots 77*b* of slide frames 77, respectively. That is, only the pulley 75 horizontally moves forward as opposing to the urging force of the spring 100 whereas the paper-guide plate 34 remains closed. When the door 42 is closed, the wire 74 is made loose and the pulley 75 slides backward by the urging force of the spring 100 to return to the original position. In the above configuration, therefore, it is possible to open the paper-guide plate 34 in response to the opening of the door 42 when the solenoid 79 is activated, while the paper-guide plate 34 is not opened regardless of the opening of the door 42 if the solenoid 79 is not activated.

In the above configuration, if a paper jam occurs in the vertical conveyer 33 and the paper-jam state is detected by the paper-jam detecting sensor 36, the operator will open the door 42 in order to cancel the paper-jam state. As the door 42 is opened, the door opening/closing detecting sensor 43 is turned off, whereby the solenoid 79 is activated. Since the paper-guide plate 34 automatically opens in response to the opening of the door 42, as stated above, it is possible to eliminate one operation step for opening the paper-guide plate 34 after the opening action of the door 42. At this moment, since the paper-jam detecting sensor 36 has detected the paper-jam state and the paper-guide plate 34 has been opened, the guide-plate opening/closing detecting sensor 35 is turned off. Accordingly, the stepping motor 63 is deactivated so that the collecting container 40, even full of waste toner, stays at the mounted position A without movement.

When the door 42 is closed after the cancellation of the paper-jam state, the paper-guide plate 34 can be closed automatically. Then, when the door 42 is reopened; since the paper-jam detecting sensor 36 detects no paper-jam state, the solenoid 79 is turned off so that the paper-guide plate 34 remains closed. Accordingly, the guide-plate opening/closing detecting sensor 35 is turned on. In this situation, if the full-state detecting sensor 54 has detected that the collecting container 40 is full, the stepping motor 63 is activated to drive the collecting container 40 from the mounted position A to the demounting position B.

As described heretofore, in accordance with the second embodiment, if paper jam has occurred in the vertical conveyer 33, the paper-guide plate 34 can automatically be opened by only opening the door 42. Further, after the cancellation of the paper jam, only closing the door 42 makes it possible to automatically shut the paper-guide plate 34. That is, it is possible to eliminate the operation steps of opening and closing the paper-guide plate 34 at the time of paper-jamming and consequently it is possible to simplify the operation of handling paper jam.

In accordance with the second embodiment, in the case where paper jam has occurred in the vertical conveyer 33; when the operator opens the door 42, the paper-guide plate 34 is opened in link with the opening of the door 42. In this while, the collecting container 40, even full of waste toner, is made to stay at the mounted position A. That is, since the apparatus is designated to give priority to the handling of paper jam over the replacement of collecting container 40, it is possible to reliably prevent interference of the collecting container 40 with the paper-guide plate 34.

(Third embodiment)

The first and second embodiment use expensive and power-consumptive parts such as various kinds of sensors, the stepping motors 63, the controller 62 having a CPU etc., and control the system depending on each condition (for example, whether the collecting container 40 is full, whether the door 42 is open, etc.), so that the collecting container 40 is adaptively moved between the mounted position A and the demounting position B. This third embodiment, however, uses a mechanical device for moving the collecting container 40 between the mounted position A and the demounting position B in accordance with each case, in place of using the electric means. That is, the third embodiment is configurated so as to reduce the producing cost as well as the cost of maintenance and create a simplified system without needing CPU control and the like.

In the third embodiment, the collecting container 40 varies its position depending upon the weight of waste toner while a door linking mechanism 80 is provided which, in link with the opening of the door 42, moves in the same direction with the movement of the collecting container 40. This door linking mechanism 80 engages the collecting container 40 or creates an integrally movable state with the collecting container 40 when the collecting container 40 is full of toner.

Figure 10:
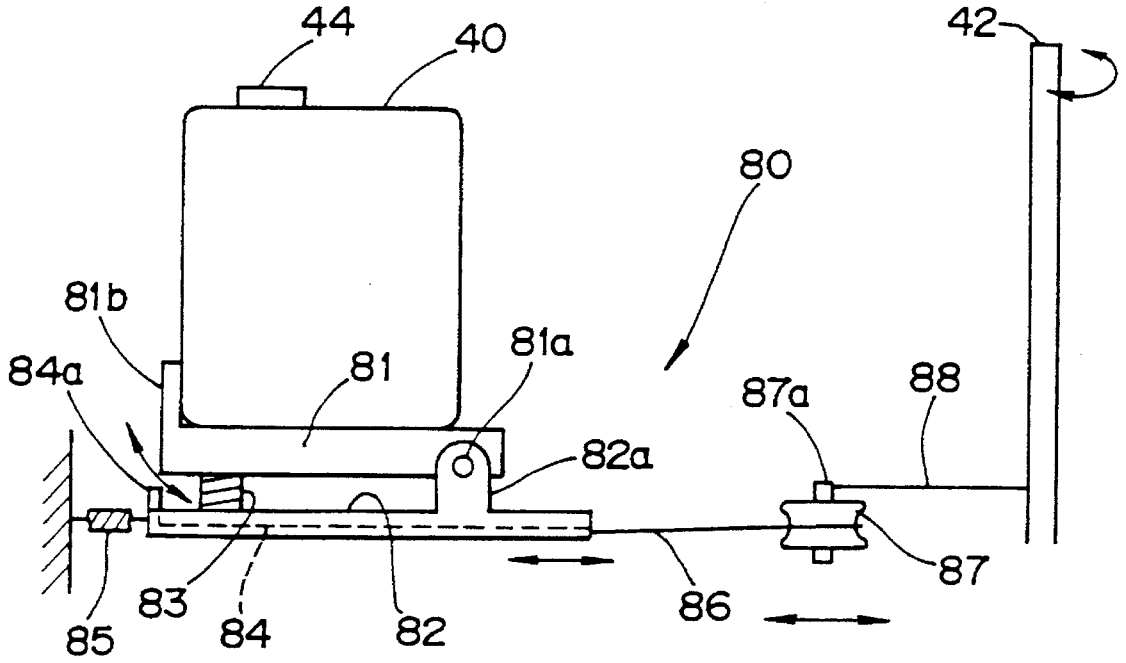
FIG. 10 is a side view showing a door linking mechanism of a third embodiment of the present invention.
Figure 11:
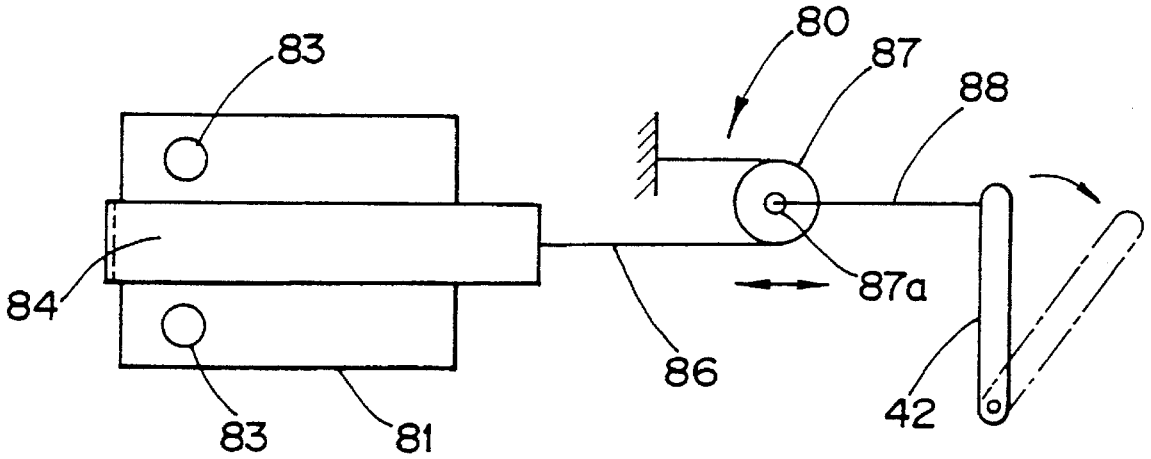
FIG. 11 is a bottom view showing the door linking mechanism.
Figure 12:
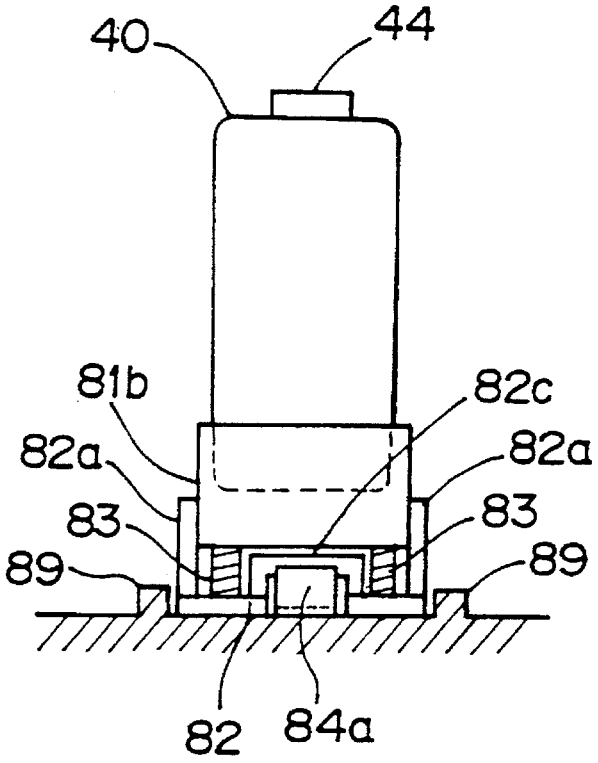
FIG. 12 is a backside view showing the door linking mechanism.

As shown in FIGS. 10, 11 and 12, the door linking mechanism 80 comprises: a rectangular (viewed from the top) container holding plate 81 on which the collecting container 40 is detachably placed; a plate supporting member 82 which is slidably placed on the bottom of the copier body 10 and rotatably supports the front part of the container holding plate 81 at both sides thereof through a rod 81*a*; a pair of right and left springs 83 interposed between the rearward undersurface of the container holding plate 81 and the plate supporting member 82 for urging the container holding plate 81 upward; a linking arm 84 which is disposed slidably on the bottom of the copier body 10 and is able to engage the container holding plate 81; a coil spring 85 disposed between the rear end of the linking arm 84 and the back board of the copier body 10 and urging the liking arm 84 rearward (toward the backside direction of the copier body 10); a first wire 86 attached at one end thereof to front end of the linking arm 84 and at the other end thereof to the frame in the copier body 10; a pulley 87 supported by the frame in the copier body 10 so as to move horizontally in the forward and rearward directions and having the first wire 86 wound therearound; and a second wire 88 attached at one end thereof to a pulley shaft 87*a* of the pulley 87 and at the other end to the door 42 at the opposite end to the rod 42*a*.

The container holding plate 81 is able to pivot between a horizontal position taken at the time the collecting container 40 is empty and a full-state position rearwardly inclined opposing to the urging force of the spring 83 due to the weight of the collecting container 40 at the time the container is full of toner. This structure allows detection of the full-state condition of the collecting container 40. Planted in the rear end of the container holding plate 81 is a container-positioning member 81*b* extending upward along the wall of the collecting container 40.

Figure 13:
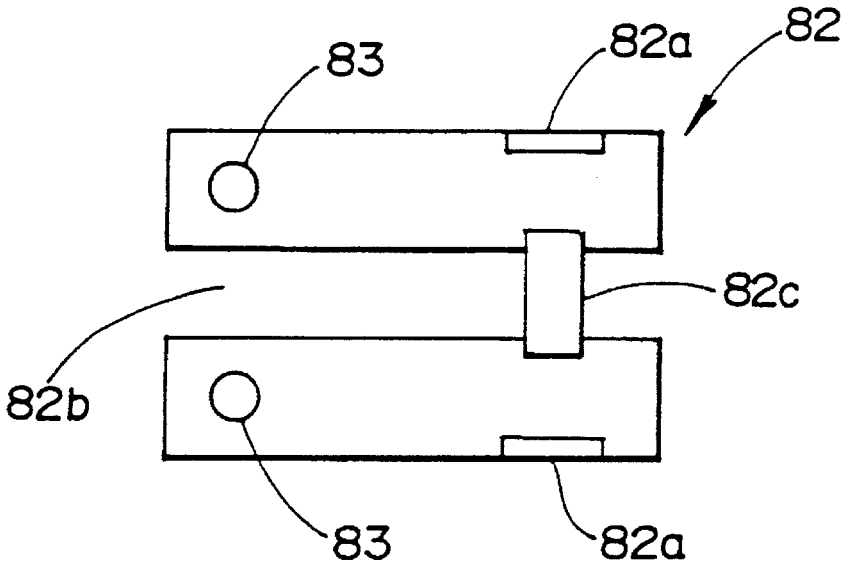
FIG. 13 is a plan view showing a plate supporting member.

The plate supporting member 82, as shown in FIGS. 12 and 13, has a pair of right and left supporting pieces 82*a* extending upward along both sides of the container holding plate 81 and a rectangular (viewed from the top) fitted slot 82*b* hollowed in the center in the longitudinal direction thereof for receiving the linking arm 84 therein. Designated at 82*c* in FIGS. 12 and 13 is a raised, connecting piece for joining the right and left parts of the plate supporting member 82.

The linking arm 84 is rectangular (viewed from the top) and has a somewhat smaller dimension than that of the fitted slot 82*b* of the plate supporting member 82. There is an engaging piece 84*a* planted in the rear end of the arm 84. This engaging piece 84*a* engages the rear end of the container holding plate 81 when it takes the full-state position. Accordingly, when the container holding plate 81 takes the full-state position, the engaging piece 84*a* catches the rear end of the container holding plate 81. In this condition, as the door 42 is opened, the linking arm 84 is moved, whereby the container holding plate 81 is pushed and moved forward. When the container holding plate 81 does not take the full-state position, the engaging piece 84*a* will not catch the rear end of the container holding plate 81. Accordingly, if the door 42 is opened, only the linking arm 84 moves forward. Designated at 89 in FIG. 12 are a pair of guide rails. These guide rails 89 are raised from the bottom of the copier body 10 and disposed along the right and left sides of the plate supporting member 82 in order to guide the plate supporting member 82 in the forward and rearward directions.

Figure 14A:
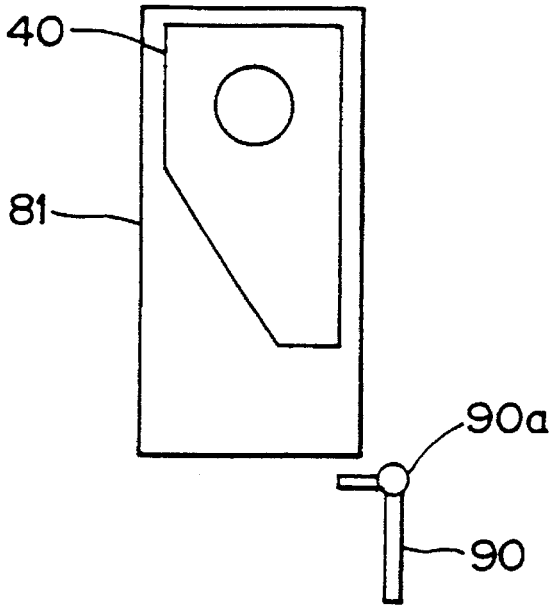
FIG. 14A is a constructional illustrative view showing an indicator.

Further, an L-angled indicator 90 supported pivotably on an axis 90*a* planted on the bottom of the copier body 10 in the forward side of the container holding plate 81 may be provided as shown in FIG. 14A. As the door 42 is opened, the container holding plate 81, as moving forward, abuts the indicator 90 so that the indicator rotates on the axis 90*a*, whereby letters 'FULL OF WASTE TONER' written on the indicator 90 can be seen from the opening 41 of the copier body 10. In this case, the axis 90*a* of the indicator 90 is planted off the moving path of the container holding plate 81. The other components are the same with those in the first embodiment and the components having similar functions to those in the first embodiment are designated with the same reference numerals.

In the above configuration, as waste toner accumulates in the collecting container 40, the collecting container 40 gradually gains weight and consequently, the rear side of the container holding plate 81 gradually downs as opposing to the urging force of the spring 83. When the collecting container 40 is not full, the container holding plate 81 does not take the full-state position where the engaging piece 84*a* of the linking arm 84 catches the plate 81. In this situation, if the door 42 is opened, the pulley 87 is pulled and moved forward by the second wire 88. By this action, however, the first wire 86 pulls only the linking arm 84 forward through under the container holding plate 81 by a length two times greater than the movement of the pulley 87, and the collecting container 40 on the container holding plate 81 remains still at the mounted position A. At this moment, the engaging piece 84*a* of the linking arm 84 is adapted to stop before abutting the connecting piece 82*c* of the plate supporting member 82. In the configuration with the indicator 90, the indicator 90 will not rotate and visually indicate the letters 'FULL OF WASTE TONER'.

Figure 14B:
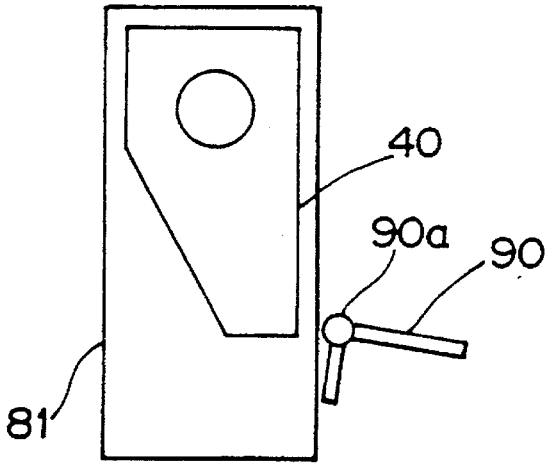
FIG. 14B is an illustrative view showing a rotated state of an indicator shown in FIG. 14A.
Figure 14C:
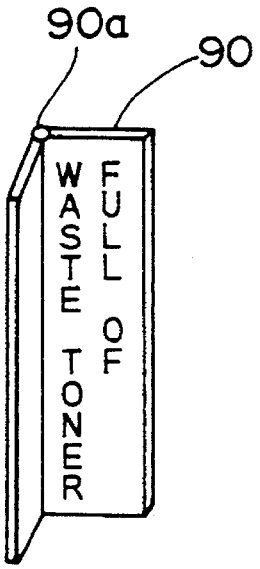
FIG. 14C is a perspective view showing a displaying example of the indicator shown in FIG. 14A.

When the collecting container 40 is full, the container holding plate 81 takes the full-state position where the plate 81 is caught by the engaging piece 84*a* of the linking arm 84. In this condition, when the door 42 is opened, the linking arm 84 is pulled forward through the second wire 88, the pulley 87 and the first wire 86 by a length two times greater than the movement of the pulley 87. Consequently, the engaging piece 84*a* of the linking arm 84 abuts the rear end of the container holding plate 81 and presses it forward, whereby the container holding 81 with the collecting container 40 mounted thereon is moved forward along the guide rails 89, together with the plate supporting member 82 supporting the container holding plate 81. By this action, the collecting container 40 moves from the mounted position A to the attaching position. At that time, if the indicator 90 is disposed, the indicator 90 is pressed by the container holding plate 81 moving forward so as to rotate and visually indicate the letters 'FULL OF WASTE TONER', as shown in FIGS. 14B and 14C.

After the replacement of the collecting container 40, the operator manually pushes the collecting container 40 from the attaching position into the mounted position A. As the door 42 is closed, the second wire 88 is made loose, so that the linking arm 84 is pulled backward by the spring coil 85 to return to the original position. When the collecting container 40 is returned to the mounted position A, the indicator 90 also is returned to the original state by an unillustrated spring.

In this way, when the collecting container 40 is full, only the opening operation of the door 42 automatically causes the collecting container 40 to move from the mounted position A to the demounting position B or the front side of the copier body 10 where the container can be easily handled. Therefore, the collecting container 40 can be replaced more easily and efficiently than in the conventional configurations in which the operator should stretch out his hand deep into the inside of the copier body to pick out the collecting container or in which the copier body should be placed in a room spaced from the wall of the room and any other obstruction in order to allow the operator to take out the collecting container from the flank or the backside of the copier body.

Further, since the movement of the collecting container 40 can be made mechanically, it is possible to reduce the producing cost as well as the cost of maintenance and create a simplified system without the need of a CPU control and the like.

Moreover, in the case of the configuration having the indictor 90, if the door 42 is opened when the collecting container 40 is full, this indicator warns the user that the collecting container 40 is full, to thereby urges the operator to replace the collecting container 40.

(Fourth embodiment)

Figure 15:
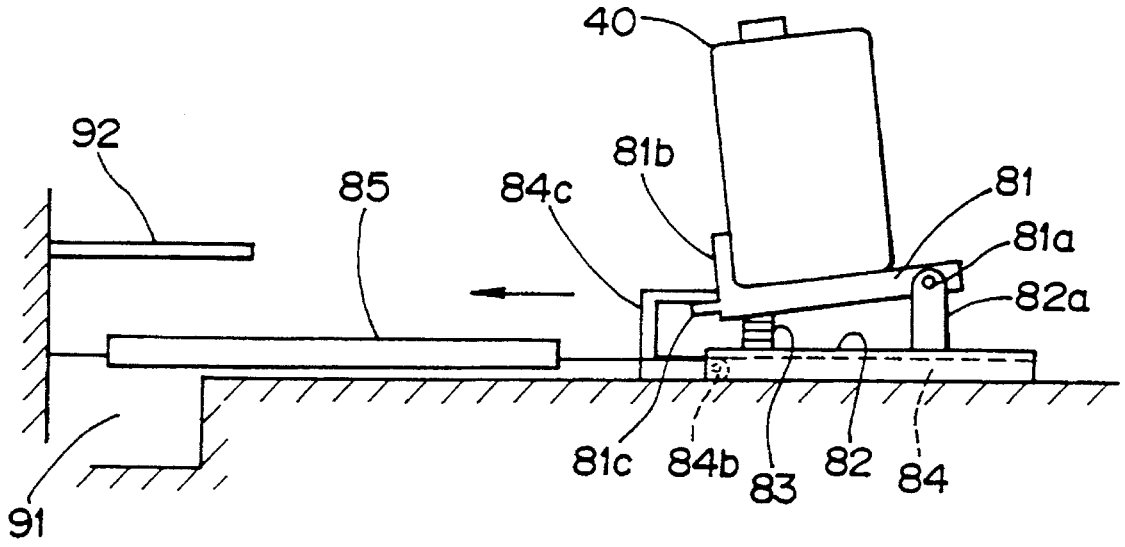
FIG. 15 is a side view showing main components of a door linking mechanism in accordance with a fourth embodiment of the present invention.

In the third embodiment, it is impossible to automatically return the collecting container 40 from the attaching position to the mounted position A when the door 42 is closed after the replacement of the collecting container 40. To deal with this, the fourth embodiment is designed to enable the system to automatically return the collecting container 40 from the attaching position to the mounted position A when the door 42 is closed. That is, as shown in FIG. 15, an engaging flange 81*c* projecting rearward is formed at the rear end of the container holding plate 81; a U-shaped engaging member 84*c*, in place of the engaging piece 84*a* of the linking arm 84, is rotatably attached to rear end of the linking arm 84 via an axis 84*b*; a depressed portion 91 into which the engaging member 84*c* is fit when the member 84*c* turns around the axis 84*b* is formed on the bottom of the copier body 10 further behind the rear end of the linking arm 84; and a holding-plate stopper 92 projecting forward is attached on the backside wall of the copier body 10 so that the stopper 92 may abut the container positioning member 81*b* of the container holding plate 81.

When the collecting container 40 becomes full so that the container holding plate 81 takes the full-state position with the rear end of the plate 81 down, the engaging member 84*c* will engage the rear end of the container holding plate 81. The holding-plate stopper 92 is provided above the engaging member 84*c* and disposed in such a position as to be able to always abut the container positioning member 81*b*, regardless of the pivoting position of the container holding plate 81. The other components are the same with those in the third embodiment, so that components having similar functions to those in the third embodiment are allotted with the same reference numerals.

In the above configuration, when the collecting container 40 is full, the container holding plate 81 takes the full-state position. In this condition, when the door 42 is opened, the linking arm 84 is pulled forward, so that the engaging member 84*c* which has been fitted in the depressed portion 91 rotates on the axis 84*b*, as abutting the side face of the depressed portion 91, to assume a standing position. Then, the engaging member 84*c* abuts the rear end of the container holding plate 81 and presses it forward, whereby the container holding plate 81 with the collecting container 40 placed thereon is moved forward, together with plate supporting member 82. By this action, the collecting container 40 moves from the mounted position A to the attaching position.

When, at the attaching position, the full collecting container 40 is removed and an empty collecting container 40 is placed on the container holding plate 81, the rear end of the container holding plate 81 is pressed downward opposing the urging force of the spring 83 so as to force the engaging flange 81*c* to engage the engaging member 84*c*. As a result, the engaging flange 81*c* comes in pressing contact with the upper part of the engaging member 84.

In this condition, when the door 42 is closed, the linking arm 84 is pulled backward by the urging force of the coil spring 85. Since the linking arm 84 and the container holding plate 81 are engaged with one another by the engagement between the engaging member 84*c* and the engaging flange 81*c*, the container holding plate 81 with the collecting container 40 thereon moves backward, as shown in FIG. 15, together with the plate supporting member 82. As a result, the collecting container 40 moves from the attaching position to the mounted position A.

Figure 16A:
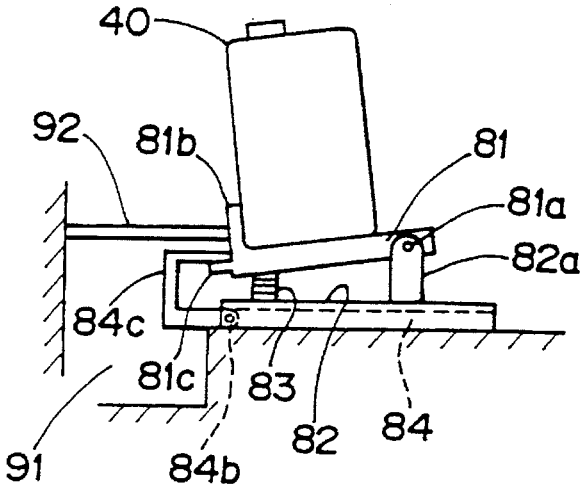
FIG. 16A is an illustrative view showing a state of the door linking mechanism when a replaced empty collecting container is returned to a mounted position by means of the engagement between an engaging member and an engaging flange.
Figure 16B:
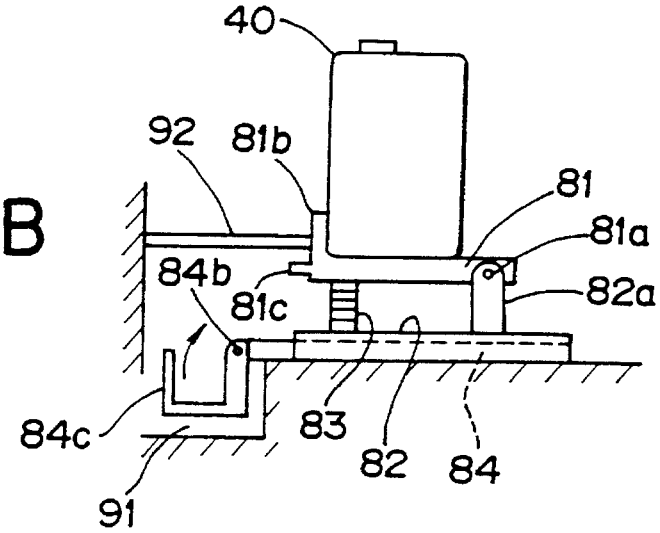
FIG. 16B is an illustrative view showing a state of the door linking mechanism when the engaging member is plunged into a depressed portion so that the engagement between the engaging member and engaging flange is released.

When the holding-plate stopper 92 abuts the container positioning member 81*b* of the container holding plate 81, the container holding plate 81 stops, therefore the collecting container 40 stops at the mounted position A as shown in FIG. 16A. The linking arm 84, however, is pulled further backward by means of the coil spring 85. When the axis 84*b* of the linking arm 84 reaches over the depressed portion 91, the engaging member 84*c* rotates on the axis 84*b* due to its own weight and plunges into the depressed portion 91, as shown in FIG. 16B. At this moment, the engagement between the engaging flange 81*c* and the engaging member 84*c* is released, so that the rear end of the container holding plate 81 is pressed up by the urging force of the spring 83, whereby the container holding plate 81 takes the horizontal position since the collecting container 40 is unfilled (empty).

Figure 16C:
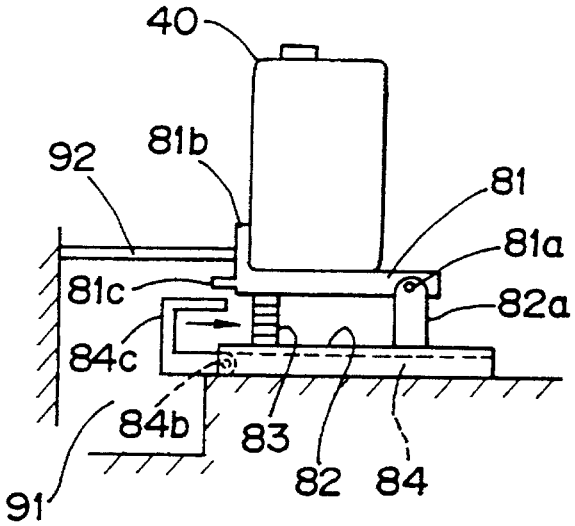
FIG. 16C is a illustrative view showing a state of the door linking mechanism when a door is opened after the engagement between the engaging member and the engaging flange is released.

Now, when the door 42 is opened, the linking arm 84 is pulled forward as shown in FIG. 16C therefore the engaging member 84*c* fitted in the depressed portion 91, as abutting the side of the depressed portion 91, rolls up on the axis 84*b*. At this moment, the container holding plate 81 assumes the horizontal position, so that no engagement is created between the engaging member 84*c* and the rear end of the container holding plate 81. Therefore, only the linking arm 84 moves forward through under the container holding plate 81 while the collecting container 40 on the container holding plate 81 remains standing still at the mounted position A.

As described above, since only the closing operation of the door 42 enables the collecting container 40 to automatically move back from the attaching position to the mounted position A, it is possible for this embodiment to attain a more efficient replacing operation of the collecting container 40, in addition to the effects of the third embodiment. Even if the operator forgets to replace the collecting container 40, it is possible to move the collecting container 40 to the attaching position by only opening the door 42.

(Fifth embodiment)

In the forth embodiment, as the door 42 is closed, the collecting container 40, in link with the door 42, moves back from the attaching position to the mounted position A, regardless of whether the collecting container 40 at the attaching position is full or empty.

Figure 17:
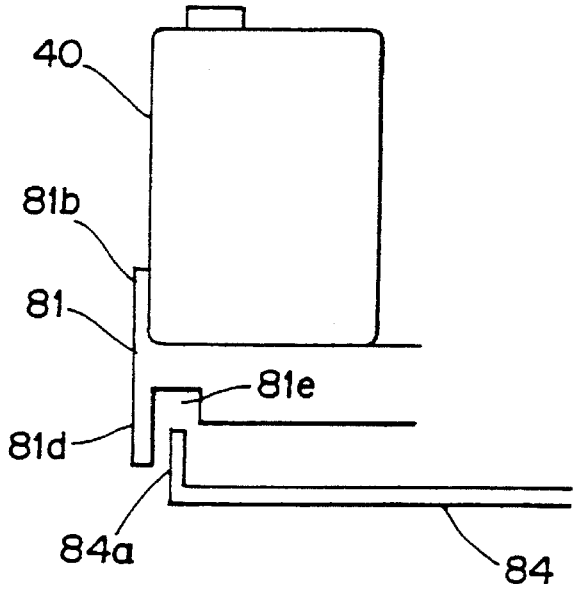
FIG. 17 is a side view showing main components of a door linking mechanism of a fifth embodiment of the present invention.
Figure 18A:
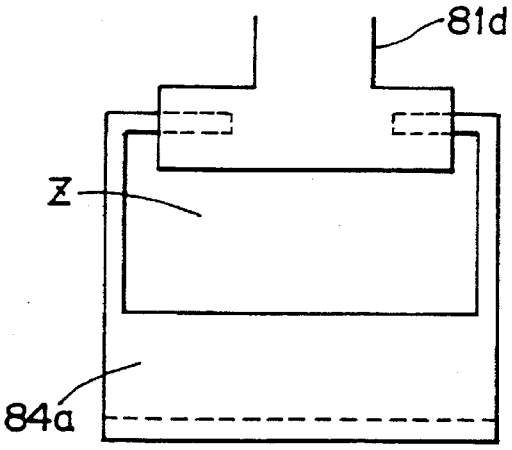
FIG. 18 is a view showing positional relation between an engaging portion and an inverted T-shaped part when the collecting container is unfilled.
FIG. 18B is a view showing positional relation between the engaging portion and the inverted T-shaped part when the collecting container is filled.
Figure 18B:
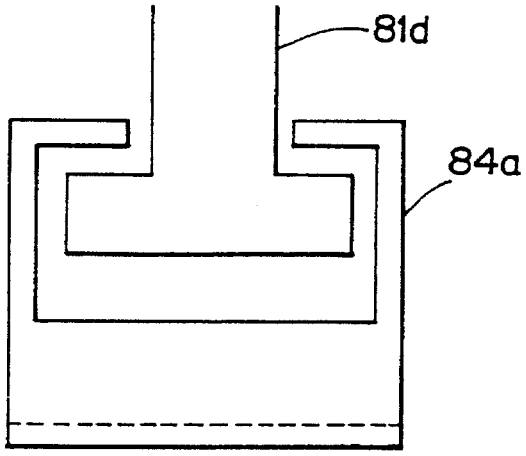

In a fifth embodiment, the collecting container 40 is adapted to return to the mounted position A from the attaching position only when the collecting container 40 at the attaching position is unfilled (empty). To achieve this, an inverted T-shaped part 81*d* projecting downward is extended at the rear end of a container holding plate 81 as shown in FIG. 17. An engaging groove 81*e* is formed on the underside of the container holding plate 81 on the forward side as compared to the inverted T-shaped part 81*d* while an engaging portion 84*a* of the linking arm 84 is placed inside the engaging groove 81*e*. Formed in the engaging portion 84*a* is an inverted T-shaped cutout Z, as shown in FIGS. 18A and 18B, which allows the inverted T-shaped part 81*d* to pass therethrough when the collecting container becomes full therefore the container holding plate 81 takes the full-state position. The other components are the same with those in the third embodiment, and the same components having the same functions with those in the third embodiment are allotted with the same reference numerals.

In the above configuration, when the collecting container 40 is full, the container holding plate 81 takes the full-state position. In this condition, if the door 42 is opened, the linking arm 84 is pulled forward so that the engaging portion 84*a* abuts the side surface of the engaging groove 81*e* of the container holding plate 81 and press the plate 81 forward. As a result, the container holding plate 81 with the collecting container 40 thereon moves forward together with the plate supporting member 82. Thus, the collecting container 40 is moved from the amounted position A to the attaching position.

When the full collecting container 40 is removed at the attaching position and an empty collecting container 40 is placed on the container holding plate 81, the container holding plate 81 assumes the horizontal position. In this condition, the door 42 is closed, the linking arm 84 is pulled rearward by the urging force of the coil spring 85. As shown in FIG. 18A, the engaging portion 84*a* of the linking arm 84 abuts the inverted T-shaped part 81*d* of the container holding plate 81 and presses it backward, whereby the container holding plate 81 with the collecting container 40 thereon is moved backward together with the plate supporting member 82. Thus, the container 40 is moved from the attaching position to the mounted position A.

When the full collecting container 40 has not been replaced and left on the container holding plate 81, the container holding plate 81 takes the full-state position. In this condition, even when the linking arm 84 is pulled backward by the urging force of the coil spring 85 as the door 42 is closed, the cutout Z of the engaging portion 84*a* of the linking arm 84 allows the inverted T-shaped part 81*d* to pass therethrough, as shown in FIG. 18B, to reach the original position. Thus, the collecting container 40 is left behind at the attaching position, to thereby warn the operator that the collecting container 40 should be replaced.

As described above, since the full collecting container 40, if it is left at the attaching position, will remain at that place as the door 42 is closed, it is possible for the embodiment to prevent the operator from forgetting to replace the collecting container, in addition to the effects of the third embodiment. When the collecting container 40 is replaced with an empty one, it is possible to return the collecting container 40 from the attaching position to the mounted position A, by only closing the door 42.

The present invention is not limited to the above-described embodiments and many variations and modifications can be made in the above embodiments within the scope of the invention.

In the third to fifth embodiments, for example, the linking mechanism 70 for closing and opening the paper-guide plate 34 of the vertical conveyer 33 in link with the opening and closing of the door 42, can be provided, so that the linking mechanism 70 can be activated only when the paper-jam state is detected in the vertical conveyer 33. In this case, power consumptive parts such as a sensor, a solenoid, a controller having CPU etc., are required.

Although the door linking mechanism 80 in the above embodiment is constructed so that the collecting container 40 is integrally moved indirectly by means of the engagement between the container holding plate 81 with the collecting container 40 thereon and the linking arm 84 when the collecting container 40 becomes full, it is possible to construct such a mechanism that the collecting container 40 may be engaged when the collecting container 40 becomes full.

As has been described heretofore, in accordance with the present invention, when the collecting container set in the mounted position on the back part of the image forming apparatus is full, it is possible to automatically move the collecting container from the mounted position to the demounting position on the front side of the image forming apparatus body where the container can be easily handled, by only opening the door. Therefore, the collecting container can be replaced more easily and efficiently than in the conventional configurations in which the operator should stretch out the hand deep into the inside of the image forming apparatus body to pick out the collecting container or in which the image forming apparatus body should be placed in a room spaced from the wall of the room and any other obstruction in order to allow the operator to take out the collecting container from the flank or the backside of the image forming apparatus body.

In accordance with the invention, since the unfilled collecting container which is newly placed at the demounting position can be automatically returned to the mounted from the demounting position to the mounted position, it is possible to further simplify and improve the replacing operation. The collecting container with full of toner stops at the demounting position, it is possible to prevent the operator from forgetting to replace the collecting container.

Further, in accordance with the invention, since the movement of the collecting container can be made mechanically without using expensive and power-consumptive parts such as a sensor, a motor, a CPU and the like, it is possible to reduce the producing cost as well as the cost of maintenance and create a simplified system without needing CPU control and the like.

Moreover, in accordance with the invention, since the same space is commonly used for the movement of the collecting container and for the opening and closing actions of the paper-guide plate for canceling paper jam in the paper conveyer, it is possible to effectively use the space inside the image forming apparatus, thus making the apparatus compact. Further, as long as the paper-guide plate is opened, the collecting container stands still at the mounted position even though the collecting container is full. Therefore, it is possible to prevent the interference between the collecting container and the paper-guide plate. When the paper-guide plate is closed after the cancellation of paper jam in the paper conveyer, the collecting container, if it is full, moves to the demounting position. Accordingly, it is possible to prevent the operator from forgetting to replace the collecting container after the cancellation of the paper jam.

What is claimed is:

1. An image forming apparatus comprising:

an image forming apparatus body;

an image forming portion disposed in said image forming apparatus body;

a paper conveying portion for feeding copy paper and delivering the paper to said image forming portion;

a removable waste-toner collecting container for collecting waste toner resulting from the image forming process in said image forming portion, said collecting container being mounted in the rear side of said paper conveying portion in said image forming apparatus body; and a door disposed on the front side of said image forming apparatus body and capable of being opened and closed, and means for moving said collecting container from a mounted position in the rear part of said image forming apparatus body, to a demounting position on the front side, so that said collecting container can be taken out through the opening of said door, when said door is opened and said collecting container is full of waste toner.

2. The image forming apparatus according to claim 1, further comprising a full-state condition detecting means for detecting whether said collecting container is full, wherein said for moving means moves said collecting container from the demounting position to the mounted position when said collecting container is empty.

3. The image forming apparatus according to claim 1, further comprising a door-linking mechanism which, linking with the opening and closing of said door, causes said means for moving to move in the same direction with the moving direction of said collecting container, wherein the position of said collecting container is displaced depending on the weight of collected waste toner so that said door-linking mechanism is engaged with said collecting container when said collecting container is full of waste toner.

4. The image forming apparatus according to claim 1, further comprising: a paper-guide plate disposed in said paper conveying portion and capable of being opened and closed for removing paper jammed in said paper conveying portion; and a movement checking means for preventing said collecting container from moving when a paper-guide plate is opened so that the same space is commonly used for the movement of said collecting container and for the opening and closing actions of said paper-guide plate.

5. The image forming apparatus according to claim 1, wherein the means for moving includes an opening operation of the door.

6. The image forming apparatus according to claim 1, wherein the means for moving includes means for moving the container from the demounted position to the mounted position.

* * * * *